US007319370B2

(12) United States Patent
Napijalo

(10) Patent No.: US 7,319,370 B2
(45) Date of Patent: Jan. 15, 2008

(54) 180 DEGREES HYBRID COUPLER

(75) Inventor: Veljko Napijalo, Dublin (IE)

(73) Assignee: TDK Corporation, Tokyo (JP)

( * ) Notice: Subject to any disclaimer, the term of this patent is extended or adjusted under 35 U.S.C. 154(b) by 179 days.

(21) Appl. No.: 11/267,339

(22) Filed: Nov. 7, 2005

(65) Prior Publication Data

US 2007/0103253 A1 May 10, 2007

(51) Int. Cl.
*H01P 5/12* (2006.01)
*H01P 5/18* (2006.01)

(52) U.S. Cl. ..... 333/117; 333/116

(58) Field of Classification Search ..... 333/109, 333/110, 111, 115, 116, 117, 118
See application file for complete search history.

(56) References Cited

U.S. PATENT DOCUMENTS 4,827,270 A * 5/1989 Udagawa et al. ..... 343/853
5,063,365 A * 11/1991 Cappucci ..... 333/121
7,042,309 B2 * 5/2006 Podell ..... 333/112

OTHER PUBLICATIONS

Myun-Joo Park and Byungje Lee. "Coupled-Line 180° Hybrid Coupler," Microwave and Optical Technology Letters, vol. 45, No. 2, Apr. 20, 2005. pp. 172-175.

* cited by examiner

*Primary Examiner*—Dean Takaoka
(74) *Attorney, Agent, or Firm*—Oliff & Berridge, PLC

(57) ABSTRACT

A multilayer 180 degree hybrid coupler comprises a cascaded pair of quarter wavelength directional couplers, one of the connections between the directional couplers being made by direct connection and the other connection being made indirectly via a length of transmission line that introduces a 180 degree phase shift at the operating frequency of the hybrid coupler. Each directional coupler comprises a pair of broadside coupled conductive tracks on opposite sides of a dielectric layer and the length of transmission line comprises a further conductive track on at least one side of the dielectric layer. Both the direct connection and the connection via the length of transmission line extend through the dielectric layer at respective via holes so that the hybrid coupler has two input ports on one side of the dielectric layer and two output ports on the other side of the dielectric layer.

2 Claims, 5 Drawing Sheets

180 DEGREES HYBRID COUPLER

BACKGROUND

1. Field of the Invention

The present invention relates to 180 degree hybrid couplers.

2. Description of the Related Art

A Hybrid coupler is a passive device that has a wide range of applications in microwave circuits. A Hybrid coupler comprises four RF ports, wherein two of the four RF ports are input ports, and two of the four RF ports are output ports. Ideal hybrid couplers are perfectly matched on all four ports; furthermore, the two input ports of an ideal hybrid coupler are mutually isolated and the two output ports are mutually isolated.

Hybrid couplers are often employed in microwave circuits for splitting a pair of input signals into two output signals; hybrid couplers can also be used for combining a pair of RF signals.

Broadly speaking, there are two types of hybrid coupler, a 90 degree hybrid coupler and a 180 degree hybrid coupler. When an RF signal is fed to either of the two input ports of a 90 degree hybrid coupler, there is a phase difference of 90 degrees between the signals at the two output ports of the coupler. For a 180 degree hybrid coupler, when an RF signal is fed to one of the two input ports, the signals at the two output ports have the same phase; on the other hand, when an RF signal is fed to the other of the two input ports, the signals at the two output ports have a phase difference of 180 degrees. The outputs and inputs of a hybrid coupler can be interchanged, and the phase relations described above still apply.

In addition to the phase relationship between the signals at the four ports of a hybrid coupler as described above, there is a relationship for the power of the signals at the output ports. For example, a −3 dB hybrid coupler divides the power of a signal at either input equally between the two output ports.

Signal division between output ports can be intentionally made unequal for some applications; however the most common applications of 180 degree hybrid couplers is feeding signals to two identical circuits, or combining the signals from two identical circuits. For these applications in particular, the equal division or combining of signals is normally required.

A number of different technologies can be employed for the fabrication of hybrid couplers. For example, microstrip technology, where metal tracks forming transmission lines are fabricated on the top side of a dielectric layer and where the bottom side of the dielectric layer is substantially covered with a metal ground plane (terms of orientation are used for convenience and refer to the orientation of the devices as seen in the drawings, and do not imply any particular orientation in use).

A conventional microstrip 180 degree hybrid coupler is illustrated in FIGS. 1 and 2, FIG. 1 being a plan view of the coupler geometry and FIG. 2 being a cross-section taken on line II-II of FIG. 1. The coupler comprises a microstrip metal ring 10 on the top side of a dielectric layer 12 whose bottom side is covered with a metal ground plane 14 (it will be appreciated that only the top metal ring 10 is shown in FIG. 1). The ring 10 has perimeter of $3\lambda/2$ with four ports connected around the ring, each port 1 to 4 being separated by $\lambda/4$, $\lambda/4$, $\lambda/4$ and $3\lambda/4$ respectively from its immediately preceding neighbour ($\lambda$ is the wavelength of the operating frequency of the coupler). When operated as a combiner with input signals applied at ports 1 and 3, the sum of the inputs will be formed at port 2, while the difference of the inputs will be formed at port 4. Hence, ports 2 and 4 are referred to as the sum ($\Sigma$) and difference ports ($\Delta$), respectively. A more detailed description of conventional hybrid couplers can be found in Pozar D: "Microwave Engineering", Second Edition, John Wiley & Sons, New York, 1998.

One of the applications of a 180 degree hybrid coupler as described above could be, for example, in monopulse radar systems where signals from two identical antennas are connected to the hybrid coupler input ports and where sum ($\Sigma$) and difference ($\Delta$) signals from the output ports of the hybrid coupler are amplified, demodulated and processed to obtain the information about target azimuth.

A recently introduced implementation of a microstrip hybrid coupler is described in Myun-Joo Park and Byungje Lee: "Coupled Line 180 Deg Hybrid Coupler", Microwave and Optical Technology Letters, Vol. 45, No. 2, Apr. 20, 2005. FIG. 3 is a plan view of the coupler and FIG. 4 is cross-section taken on line IV-IV of FIG. 3. This implementation comprises a cascaded pair of quarter wavelength edge-coupled directional couplers 16 and 18 respectively, where one of the connections between the pair of directional couplers is made by direct connection 20 and the other connection between the pair of directional couplers is made using a loop of microstrip line 22 that introduces a phase shift of 180 degrees at the operating frequency of the coupler. It can be shown that this topology has the same electrical properties as the 180 degree hybrid coupler of FIGS. 1 and 2. It can also be shown that for −3 dB coupling between either input and either output of the hybrid coupler (equal power splitting between the output ports) the coupling ratios of each of the individual directional couplers should be −7.7 dB.

SUMMARY

It can be seen from FIGS. 2 and 4 that in each case the input and output ports are interspersed, i.e. they alternate around the coupler. These interspersed input and output ports can be a significant problem to a designer when a hybrid coupler is implemented in the layout of a complex microstrip circuit.

Modern microwave circuits are often fabricated using multilayer technology as this technology offers many advantages for size reduction and cost cutting. For example, one type of multilayer technology, commonly referred to as low temperature co-fired ceramic (LTCC), is produced as follows: metallised tracks are printed on several layers of ceramic material, a number of via holes are punched through each layer of ceramic, and the holes are filled with a metallised paste. The ceramic layers are then stacked together and fired in an oven. The resulting LTCC substrate can include a highly complex electronic circuit comprising discrete and distributed components, where the electronic circuit occupies a much smaller area than that would be required to produce the same circuit using microstrip lines and SMT (surface mounted technology) components.

The hybrid microstrip coupler of FIGS. 3 and 4 can be fabricated in multilayer technology by replacing the edge coupled metal tracks of FIG. 4 with broadside coupled metal tracks, where the coupling ratio of the broadside coupled lines is maintained at the same ratio as that for the edge-coupled lines of FIG. 4 (for example, −7.7 dB for equal power splitting of a signal at either input between the two output ports). Such an implementation is shown in FIGS. 5 to 7, where FIG. 5 is a perspective view of the layout of the metal tracks of the hybrid coupler, FIG. 5*a* is a plan view of the layout of the metal tracks of FIG. 5, FIG. 6 is cross-section taken on line VII-VII of FIG. 5*a*, and FIG. 7 is an electrical diagram of the hybrid coupler of FIGS. 5 and 6. In FIGS. 5 and 5*a* the dielectric ceramic layers 24, 26 shown in FIG. 6, as well as the ground plane 14, are omitted for clarity.

In this implementation, the directional coupler 16 comprises the metal tracks 16*a*, 16*b* in register on the top and bottom sides respectively of the dielectric layer 24. Likewise, the directional coupler 18 comprises the metal tracks 18*a*, 18*b* in register on the top and bottom sides respectively of the dielectric layer 24. Two input metal tracks 30*a*, 30*b* are routed to the inputs of the hybrid coupler from one direction on the layer 24, and another two metal tracks 32*a*, 32*b* are routed to the outputs of the hybrid coupler from opposite directions on the layer 24.

Metal tracks 30*a*, 32*b*, 16*a* and 18*a* on the top side of dielectric ceramic layer 24, are shown wider than the metal tracks 30*b*, 32*a*, 16*b* and 18*b* on the bottom side of dielectric ceramic layer 24 in FIG. 5 and FIG. 5*a*. It is convenient to design metal tracks 16*a* and 18*a* so that they have the same widths as metal tracks 30*a* and 32*b*; this eliminates discontinuities at the transitions between metal track 30*a* and 16*a*, and between metal track 32*b* and 18*a*. The widths of metal tracks 16*b* and 18*b* on the bottom of dielectric ceramic layer 24, are chosen so that each of broadside couplers 16 and 18 has the desired coupling ratio (−7.7 dB for −3 dB coupling between either input and either output of the 180 degree hybrid coupler). For typical multilayer structures, and for the case where metal tracks 30*a*, and 32*b* have a characteristic impedance of 50 Ohms, and for −7.7 dB coupling ratio of directional couplers 16 and 18, the metal tracks on the bottom side of the dielectric layer 24 are narrower than those on the top side of the dielectric layer 24. This design approach has the further advantage of desensitising the electrical characteristics of the hybrid coupler to misalignment of the metal tracks on either sides of dielectric layer 24 during manufacturing.

The implementation of the hybrid coupler shown in FIGS. 5 to 7 has input and output ports which are no longer interspersed.

A problem with the implementation of the hybrid coupler shown in FIGS. 5 to 7 is that the input ports are fabricated on separate layers of the multilayer substrate, and similarly the output ports are fabricated on separate layers of the multilayer substrate. This is a disadvantage if absolute symmetry is required.

For example, if two identical antennas are connected at the input ports then an additional connecting element is required to bring one of the input ports (say 1) to the same layer as the other one (3). If the output ports of the hybrid coupler are connected to identical amplifiers with connection points on the same layer, then one of the output ports (say 2) should have an additional connecting element to trace the signal to the upper layer (4). However, any structural asymmetry that might be introduced in the input metal tracks or in the output metal tracks would necessarily introduce unwanted phase changes in the signal paths, these phase changes would result in the performance of the hybrid coupler being less than optimum.

Accordingly, the present invention provides a multilayer 180 degree hybrid coupler comprising a cascaded pair of quarter wavelength directional couplers, one of the connections between the directional couplers being made by direct connection and the other connection being made indirectly via a length of transmission line that introduces a 180 degree phase shift at the operating frequency of the hybrid coupler, wherein each directional coupler comprises a pair of broadside coupled conductive tracks on opposite sides of a dielectric layer and the length of transmission line comprises a further conductive track on at least one side of the dielectric layer, both the direct connection and the connection via the length of transmission line extending through the dielectric layer so that the hybrid coupler has two input ports on one side of the dielectric layer and two output ports on the other side of the dielectric layer.

The present invention solves the problem of interspersed input and output ports in prior art 180 degree hybrid couplers by using broad side coupled lines and rearranging the connections between the constituent directional couplers.

Preferably the further conductive track is wholly on one side of the dielectric layer and the connection via the length of transmission line extends through the dielectric layer at one end of the further conductive track.

An embodiment of the invention will now be described, by way of example, with reference to the accompanying drawing.

DETAILED DESCRIPTION OF EMBODIMENTS

Figure 1:
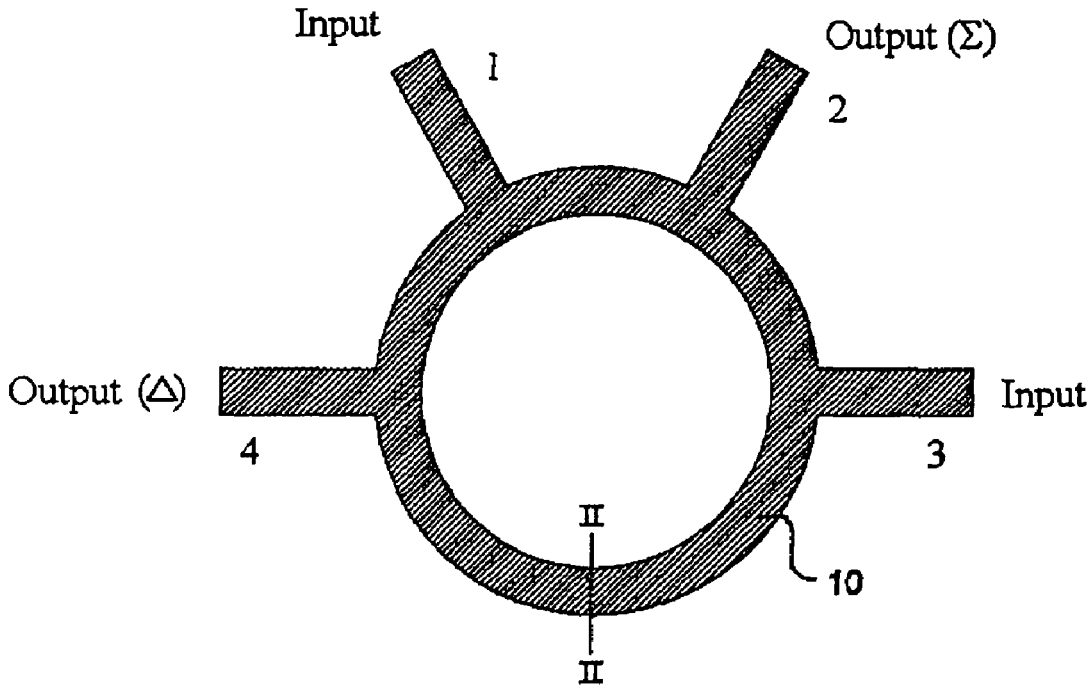
Figure 1 Related Art
FIG. 1 is a plan view of a microstrip 180 degree hybrid coupler using conventional microstrip geometry.
Figure 2:
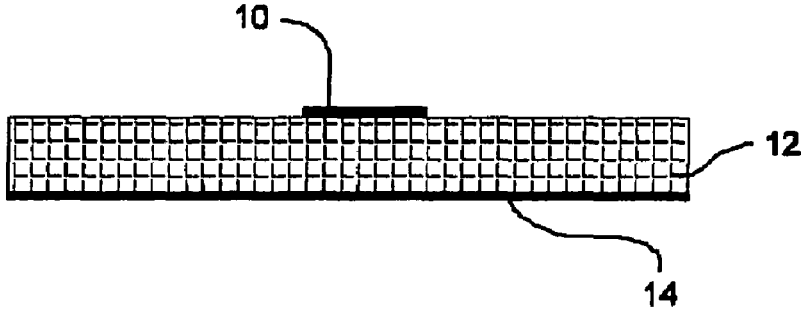
Figure 2 Related Art
FIG. 2 is cross-section taken on line II-II of FIG. 1.
Figure 3:
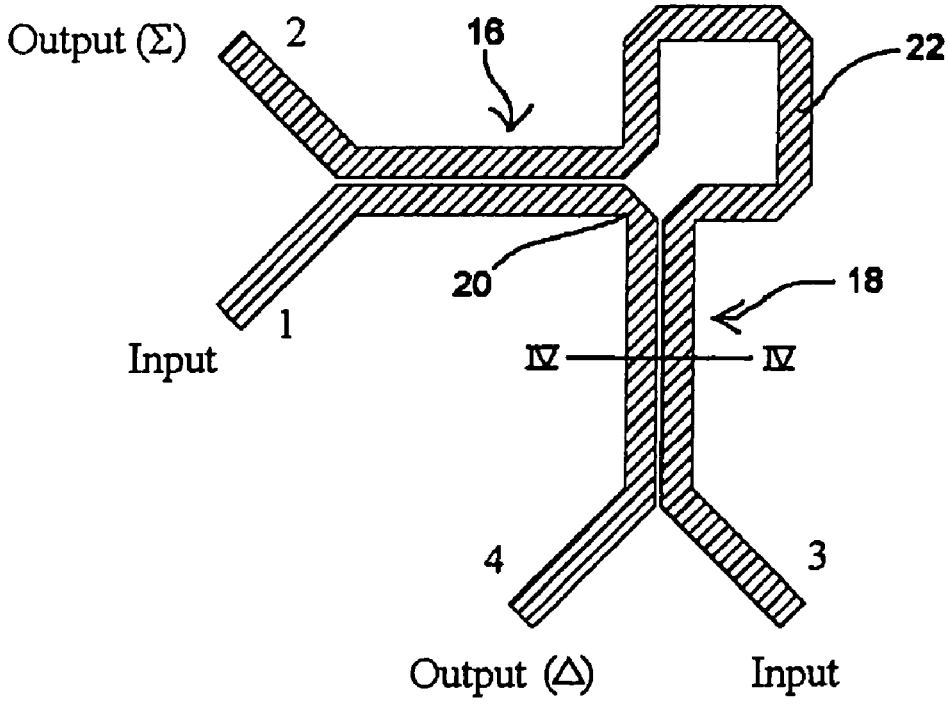
Figure 3 Related Art
FIG. 3 is a plan view of a microstrip 180 degree hybrid coupler using conventional edge-coupled microstrip geometry.
Figure 4:
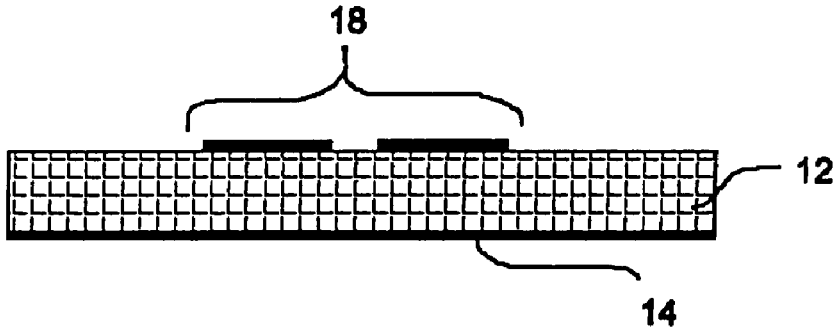
Figure 4 Related Art
FIG. 4 is cross-section taken on line IV-IV of FIG. 3.

In the drawings the same reference numerals have been used for the same or equivalent components.

Figure 5:
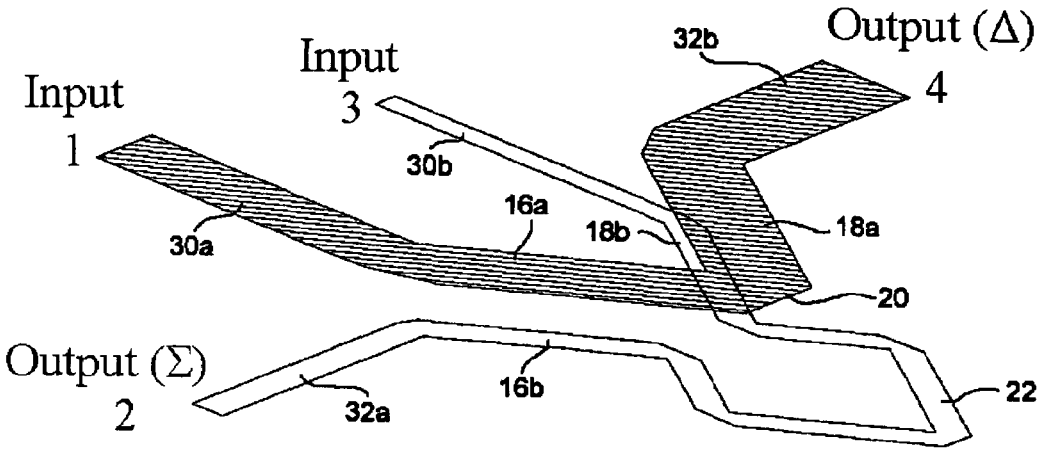
FIG. 5 is a perspective view of the layout of the metal tracks of a broadside coupled version of the 180 degree hybrid coupler of FIG. 3.
Figure 5A:
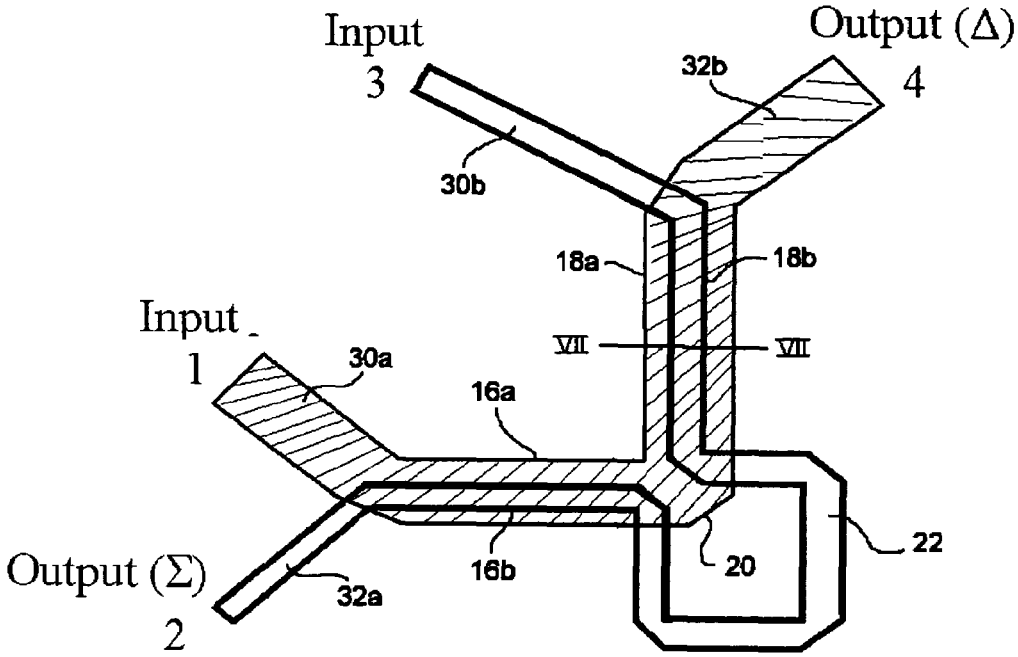
FIG. 5*a* is a plan view of the layout of the metal tracks of FIG. 5.
Figure 6:
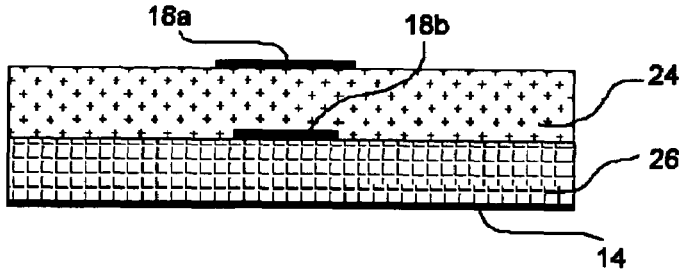
FIG. 6 is cross-section taken on line VII-VII of FIG. 5*a*.
Figure 7:
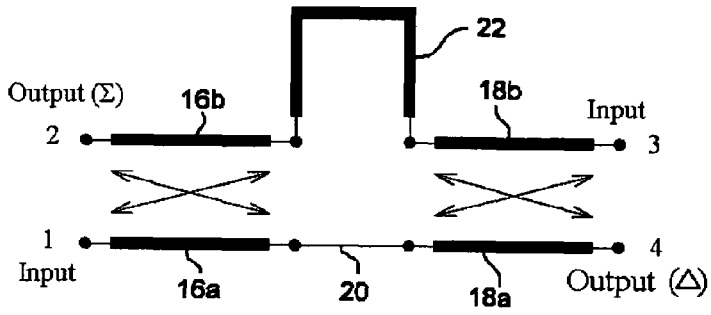
FIG. 7 is an electrical diagram of the hybrid coupler of FIGS. 5 and 6.
Figure 8:
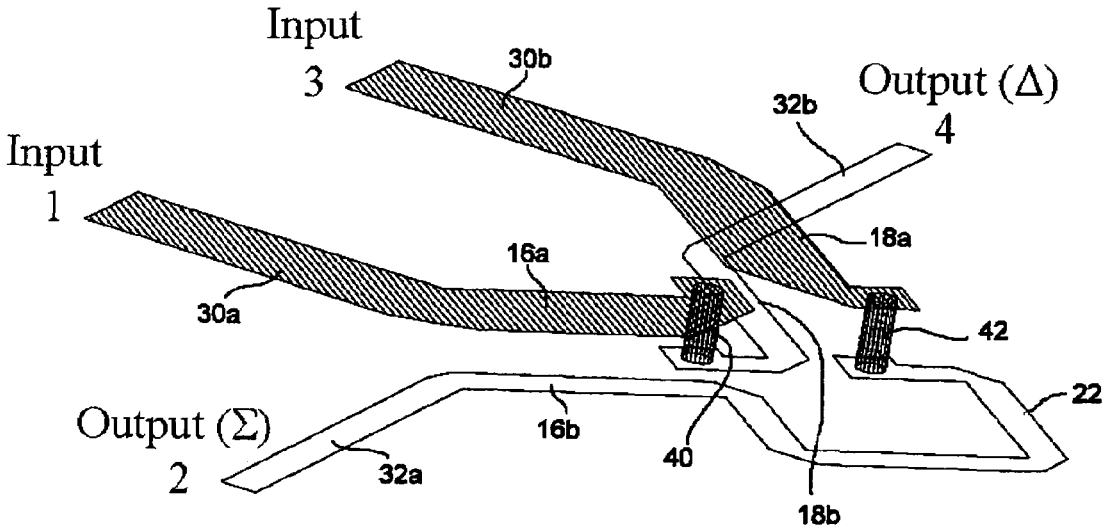
FIG. 8 is a perspective view of the layout of the metal tracks of an embodiment of the invention which is a modification of the coupler of FIGS. 5 to 7.
Figure 9:
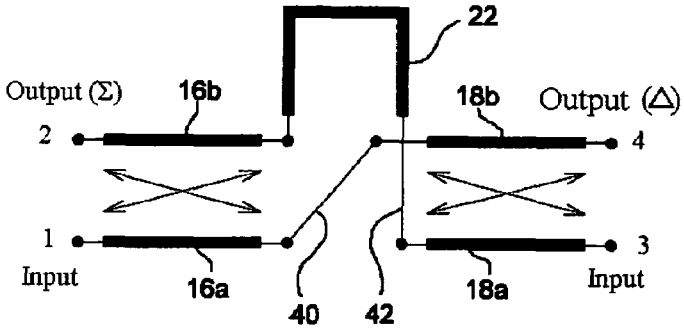
FIG. 9 is an electrical diagram of the hybrid coupler of FIG. 8.

FIGS. 8 and 9 illustrate an embodiment of the invention which is a modification of the implementation of FIGS. 5 to 7. In the embodiment, the direct connection 20 previously made on the top side of the dielectric layer 24 between the directional coupler sections 16*a* and 18*a* is now made through the thickness of the layer 24 by a conductive via hole 40 which connects the coupler sections 16*a* and 18*b* on the top and bottom sides of the layer 24 respectively. Similarly, the connection previously made on the bottom side of the dielectric layer 24 between the directional coupler section 18*b* and one end of the looped track 22 is now made through the thickness of the layer 24 by a conductive via hole 42 which connects the coupler section 18*a* on the top side of the layer 24 to the end of the track 22 of the bottom side of the layer 24.

By this means, and as shown in FIG. 8, the input ports 1 and 3 are both present on the top side of the layer 24 and the output ports 2 and 4 are both present on the bottom side of the layer 24. The cross-section of the embodiment taken through the directional coupler 18*a*/18*b* is as shown in FIG. 6. The electrical diagram of the embodiment is shown in FIG. 9.

Figure 10:
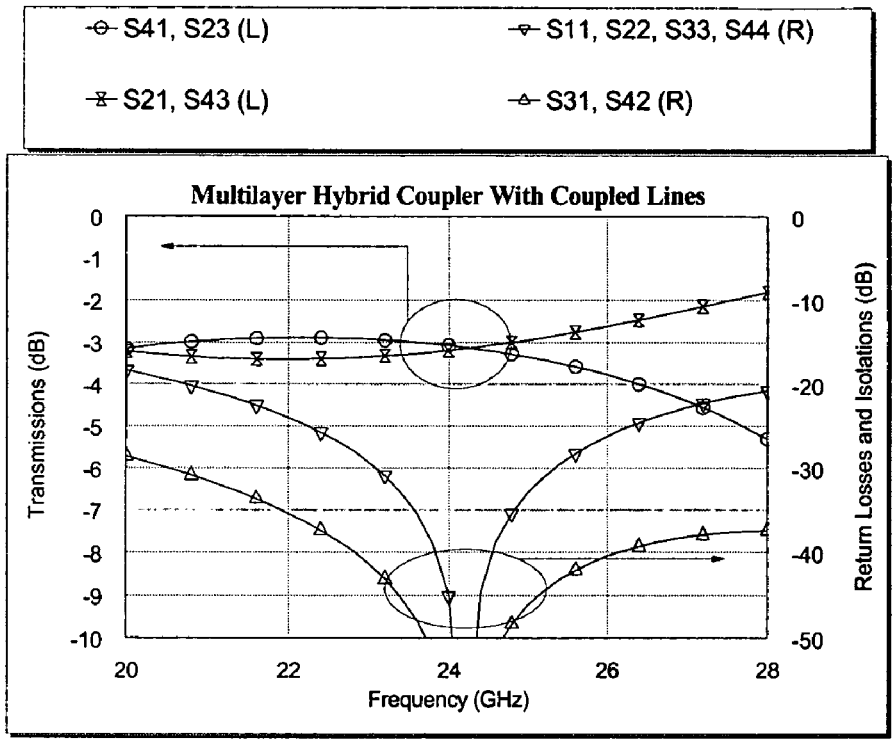
FIG. 10 is a graph showing plots of all of the simulated s-parameters of the hybrid coupler of FIG. 8.
Figure 11:
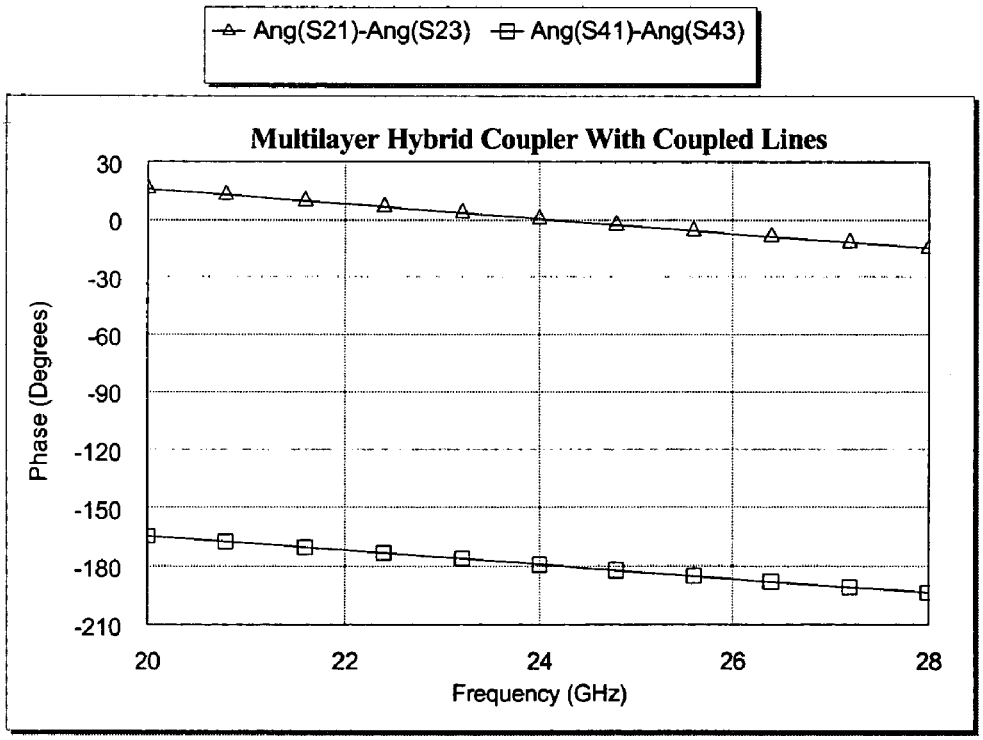
FIG. 11 is a graph with two plots: the first plot shows the simulated difference between the phase of the responses of the hybrid coupler of FIG. 8 at output port 2 for an input at port 1 and for an input at port 3; the second plot shows the simulated difference between the phase of the response of the hybrid coupler of FIG. 8 at output port 4 for an input at port 1 and for an input at port 3.

The electrical characteristics of the multilayer 180 degree hybrid coupler of FIG. 8 were simulated using a 3D circuit simulation software. It can be seen from FIGS. 10 and 11 that the performance of the hybrid coupler of FIG. 8 is close to ideal. Transmission from either input port to either output port is −3 dB at the operating frequency (indicating equal power splitting). The coupler is well matched at all ports, the input ports are mutually isolated and the output ports are also mutually isolated. The phase of the responses from port 1 to port 2 and from port 3 to port 2 are equal; similarly, the phase of the responses from port 1 to port 4 and from port 3 to port 4 differ by 180 degrees. Thus, the structure shown in FIG. 8 has the required electrical properties of a 180 degree hybrid coupler.

Although the foregoing embodiment has the looped track 22 formed wholly on the bottom side of the dielectric layer 24 with the via hole 42 extending through the dielectric layer at one end of the looped track 22, the track 22 could alternatively be formed wholly on the top side of the layer 24 with the via hole 42 located at the other end of the track. Also, the track 22 could be formed partially on the top side of the layer 24 and partially on the bottom side of the layer 24, with the via hole 42 located between the ends of the track 22.

The invention is not limited to the embodiments described herein, which may be modified or varied without departing from the scope of the invention.

The invention claimed is:

1. A multilayer 180 degree hybrid coupler comprising a cascaded pair of quarter wavelength directional couplers, one of the connections between the directional couplers being made by direct connection and the other connection being made indirectly via a length of transmission line that introduces a 180 degree phase shift at the operating frequency of the hybrid coupler, wherein each directional coupler comprises a pair of broadside coupled conductive tracks on opposite sides of a dielectric layer and the length of transmission line comprises a further conductive track on at least one side of the dielectric layer, both the direct connection and the connection via the length of transmission line extending through the dielectric layer so that the hybrid coupler has two input ports on one side of the dielectric layer and two output ports on the other side of the dielectric layer.

2. A hybrid coupler as claimed in claim 1, wherein the further conductive track is wholly on one side of the dielectric layer and the connection via the length of transmission line extends through the dielectric layer at one end of the further conductive track.

* * * * *